US005697707A

United States Patent [19]

Esposito

[11] Patent Number: 5,697,707

[45] Date of Patent: Dec. 16, 1997

[54] COMPARTMENTALIZED FOOD AND BEVERAGE BAG WITH REINFORCEMENT SHIELDS

[76] Inventor: David P. Esposito, 3950 Daystar Dr., Doylestown, Pa. 18901

[21] Appl. No.: 546,818

[22] Filed: Oct. 23, 1995

[51] Int. Cl.[6] ..... B65D 30/22

[52] U.S. Cl. ..... 383/38; 383/40; 383/97; 383/63; 383/104; 383/108; 383/113; 383/116; 426/112; 426/115; 426/120; 206/217; 206/466; 206/542; 206/545; D7/601; D7/602; D7/701; D7/619; D9/347; D3/274; D3/283; D3/319

[58] Field of Search ..... 426/112, 115, 426/120; 206/217, 541, 561, 562, 466, 542, 546, 545; 383/38, 40, 97, 108, 113, 116, 104, 63; D7/601, 602, 607, 701, 619; D9/347; D3/274, 283, 287, 319

[56] References Cited

U.S. PATENT DOCUMENTS

| | | | |
|---|---|---|---|
| D. 285,158 | 8/1986 | Combs et al. | D7/77 |
| D. 349,191 | 8/1994 | Mason | D3/289 |
| 1,860,244 | 5/1932 | Grant | 383/113 |
| 2,083,860 | 6/1937 | Offenbacher | 206/541 |
| 2,189,431 | 2/1940 | Moore | 383/113 X |
| 2,654,527 | 10/1953 | Geckler et al. | 383/40 |
| 2,867,372 | 1/1959 | Fox | 383/40 X |
| 3,349,991 | 10/1967 | Kessler | 383/38 X |
| 3,456,866 | 7/1969 | Civitello | 383/40 |
| 4,127,155 | 11/1978 | Hydorn | 383/38 X |
| 4,542,826 | 9/1985 | Adams | 206/247 |
| 4,708,248 | 11/1987 | Davis | 383/38 X |
| 4,762,514 | 8/1988 | Yoshida | 493/227 |
| 4,819,793 | 4/1989 | Willard et al. | 206/541 X |
| 4,863,287 | 9/1989 | Marsik | 383/113 |
| 4,869,599 | 9/1989 | Allen | 383/38 |
| 4,946,094 | 8/1990 | Stang | 206/542 X |
| 4,991,980 | 2/1991 | Cohen et al. | 383/40 |
| 4,993,845 | 2/1991 | Faltynek | 383/40 |
| 5,020,921 | 6/1991 | Beales | 383/38 |
| 5,181,612 | 1/1993 | Liu | 206/546 |
| 5,354,131 | 10/1994 | Mogil | 383/24 |
| 5,464,150 | 11/1995 | Sanchez et al. | 426/115 X |

*Primary Examiner*—Milton Cano

[57] ABSTRACT

A compartmentalized food and beverage bag with reinforcement shields comprising: a bag fabricated of wax coated paper and including four side walls, a floor and an open top, two side walls including a crease to permit collapsible folding of the bag, the floor of the bag having an upper surface including a wax coated cardboard reinforcement member positioned adjacent to a first side wall, the first side wall also including a vertically positioned waxed cardboard reinforcement member affixed thereto, a drink holder ring fabricated of wax coated cardboard and formed in a generally circular configuration being affixed to the vertical reinforcement member, in an operative orientation a beverage cup being positioned through the ring with the lower surface of the cup being positioned upon the reinforcement member on the bottom of the bag, the waxed cardboard ring and reinforcement member enabling the bag to support the weight of a full beverage cup without risk of spillage occurring.

1 Claim, 3 Drawing Sheets

COMPARTMENTALIZED FOOD AND BEVERAGE BAG WITH REINFORCEMENT SHIELDS

BACKGROUND OF THE INVENTION

1. Field of the Invention

The present invention relates to a compartmentalized food and beverage bag with reinforcement shields and more particularly pertains to securely positioning food and beverage items within the compartments of the bag to prevent spillage or seepage during transport.

2. Description of the Prior Art

The use of carry bags is known in the prior art. More specifically, carry bags heretofore devised and utilized for the purpose of transporting various items are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 4,542,826 to Adams a flexible bag type beverage can carrier.

U.S. Pat. No. 5,181,612 to Liu discloses a compact collapsible lunch box.

U.S. Pat. No. Des. 285,158 to Combs discloses an insulated six-pack beverage carrier and lunch bag.

U.S. Pat. No. 5,354,131 to Mogil discloses a bag handle with support loop.

U.S. Pat. No. Des. 349,192 to Mason discloses a combination food and beverage carry bag.

Lastly, U.S. Pat. No. 4,762,514 to Yoshida discloses a method of making beverage packaging bag.

In this respect, the compartmentalized food and beverage bag with reinforcement shields according to the present invention substantially departs from the conventional concepts and designs of the prior art, and in doing so provides an apparatus primarily developed for the purpose of securely positioning food and beverage items within the compartments of the bag to prevent spillage or seepage during transport.

Therefore, it can be appreciated that there exists a continuing need for a new and improved compartmentalized food and beverage bag with reinforcement shields which can be used for securely positioning food and beverage items within the compartments of the bag to prevent spillage or seepage during transport. In this regard, the present invention substantially fulfills this need.

SUMMARY OF THE INVENTION

In view of the foregoing disadvantages inherent in the known types of carry bags now present in the prior art, the present invention provides an improved compartmentalized food and beverage bag with reinforcement shields. As such, the general purpose of the present invention, which will be described subsequently in greater detail, is to provide a new and improved compartmentalized food and beverage bag with reinforcement shields and method which has all the advantages of the prior art and none of the disadvantages.

To attain this, the present invention essentially comprises a new and improved compartmentalized food and beverage bag with reinforcement shields comprising, in combination: a beverage cup, the cup being formed in a cylindrical configuration with an open upper end and a flat lower end, the upper end having a larger diameter than the lower end, the cup being filled with beverage in an operative orientation; a bag fabricated of wax coated paper and including two wide side walls, two narrow side walls, a floor and an open top, the walls and floor each having an inner surface and an outer surface, each side wall including an upper edge and being positioned vertically in an operative orientation, each narrow side wall having a crease at its approximate centerpoint to permit collapsible folding of the bag; a flexible zipper pouch formed in an elongated rectangular configuration and affixed to the outer surface of a first wide side wall of the bag, the pouch having an upper extent positioned adjacent to the upper edge of the wide side wall of the bag, the upper extent of the zipper pouch including a snap seal coupling device to permit secure storage of items within the pouch; and the floor of the bag having an upper surface including a wax coated cardboard reinforcement member positioned adjacent to a first thin side wall, the approximate centerpoint of the first thin side wall including a vertically positioned waxed cardboard reinforcement member affixed thereto, a drink holder ring fabricated of wax coated cardboard and formed in a generally circular configuration being affixed to the vertical reinforcement member, in an operative orientation the beverage cup being positioned through the ring with the lower surface of the cup being positioned upon the reinforcement member on the bottom of the bag, the waxed cardboard ring and reinforcement member enabling the bag to support the weight of a full beverage cup without risk of spillage occurring, a second thin side wall of the bag including a generally rectangular shaped holder coupled thereto adjacent to the floor, the rectangular shaped holder having an open top and adapted to receive french fries, hamburgers or other food items in an operative orientation, the wax coating of the bag preventing the seeping of fluids through the bag.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved compartmentalized food and beverage bag with reinforcement shields which has all of the advantages of the prior art carry bags and none of the disadvantages.

It is another object of the present invention to provide a new and improved compartmentalized food and beverage bag with reinforcement shields which may be easily and efficiently manufactured and marketed.

It is further object of the present invention to provide a new and improved compartmentalized food and beverage bag with reinforcement shields which is of durable and reliable constructions.

An even further object of the present invention is to provide a new and improved compartmentalized food and beverage bag with reinforcement shields which is susceptible of a low cost of manufacture with regard to both materials and labor, and which accordingly is then susceptible of low prices of sale to the consuming public, thereby making such compartmentalized food and beverage bag with reinforcement shields economically available to the buying public.

Still yet another object of the present invention is to provide a new and improved compartmentalized food and beverage bag with reinforcement shields which provides in the apparatuses and methods of the prior art some of the advantages thereof, while simultaneously overcoming some of the disadvantages normally associated therewith.

Still another object of the present invention is to securely position food and beverage items within the compartments of the bag to prevent spillage or seepage during transport.

Lastly, it is an object of the present invention to provide a new and improved compartmentalized food and beverage bag with reinforcement shields comprising: a bag fabricated of wax coated paper and including four side walls, a floor and an open top, two side walls including a crease to permit collapsible folding of the bag, the floor of the bag having an upper surface including a wax coated cardboard reinforcement member positioned adjacent to a first side wall, the first side wall also including a vertically positioned waxed cardboard reinforcement member affixed thereto, a drink holder ring fabricated of wax coated cardboard and formed in a generally circular configuration being affixed to the vertical reinforcement member, in an operative orientation a beverage cup being positioned through the ring with the lower surface of the cup being positioned upon the reinforcement member on the bottom of the bag, the waxed cardboard ring and reinforcement member enabling the bag to support the weight of a full beverage cup without risk of spillage occurring.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
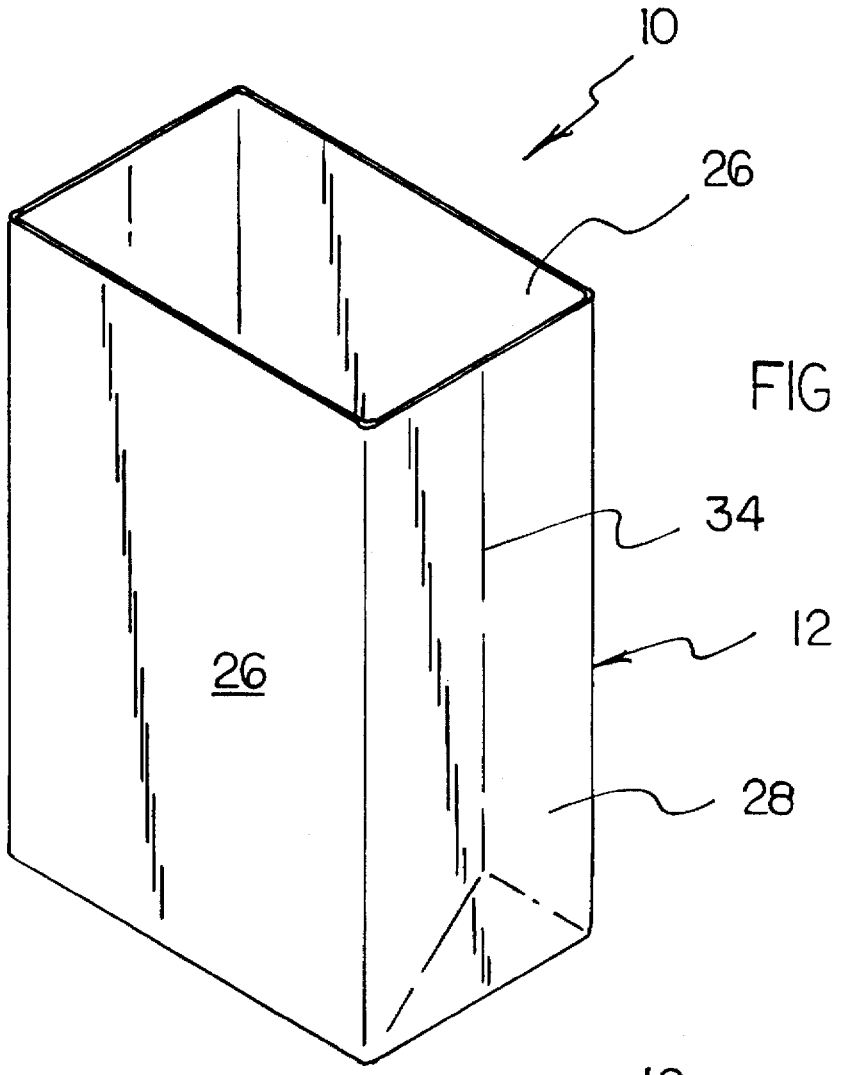
FIG. 1 is a perspective view of the preferred embodiment of the compartmentalized food and beverage bag with reinforcement shields constructed in accordance with the principles of the present invention.

With reference now to the drawings, and in particular to FIG. 1 thereof, the preferred embodiment of the new and improved compartmentalized food and beverage bag with reinforcement shields embodying the principles and concepts of the present invention and generally designated by the reference numeral 10 will be described.

The present invention, the compartmentalized food and beverage bag with reinforcement shields 10 is comprised of a plurality of components. Such components in their broadest context include a bag 12, a zipper pouch 14, a drink holder ring 16 and a rectangular shaped holder 18. Such components are individually configured and correlated with respect to each other so as to attain the desired objective.

More specifically, the apparatus includes a beverage cup 20 formed in a cylindrical configuration with an open upper end and a flat lower end. The upper end has a larger diameter than the lower end. The cup is filled with beverage in an operative orientation. The bag is adapted to hold items that would normally be purchased at a fast food establishment. Such items include packaged hamburgers 22 and packets of french fries 24.

A bag 12 is fabricated of wax coated paper and includes two wide side walls 26, two narrow side walls 28, a floor 30 and an open top 32. The walls and floor each have an inner surface and an outer surface. In the preferred embodiment both the inner and outer surfaces of the bag include a wax coating to minimize seepage of fluids through the bag. In alternative embodiments of the apparatus only the inner or outer surface of the bag includes the wax coating. Each side wall includes an upper edge and is positioned vertically in an operative orientation. Each narrow side wall has a crease 34 at its approximate centerpoint to permit collapsible folding of the bag. The crease extends into the corners of the bag so that a user may easily collapse the bag by pushing the creases inwardly. The bag can then be easily folded, stored or stacked. Note FIG. 1.

Figure 6:
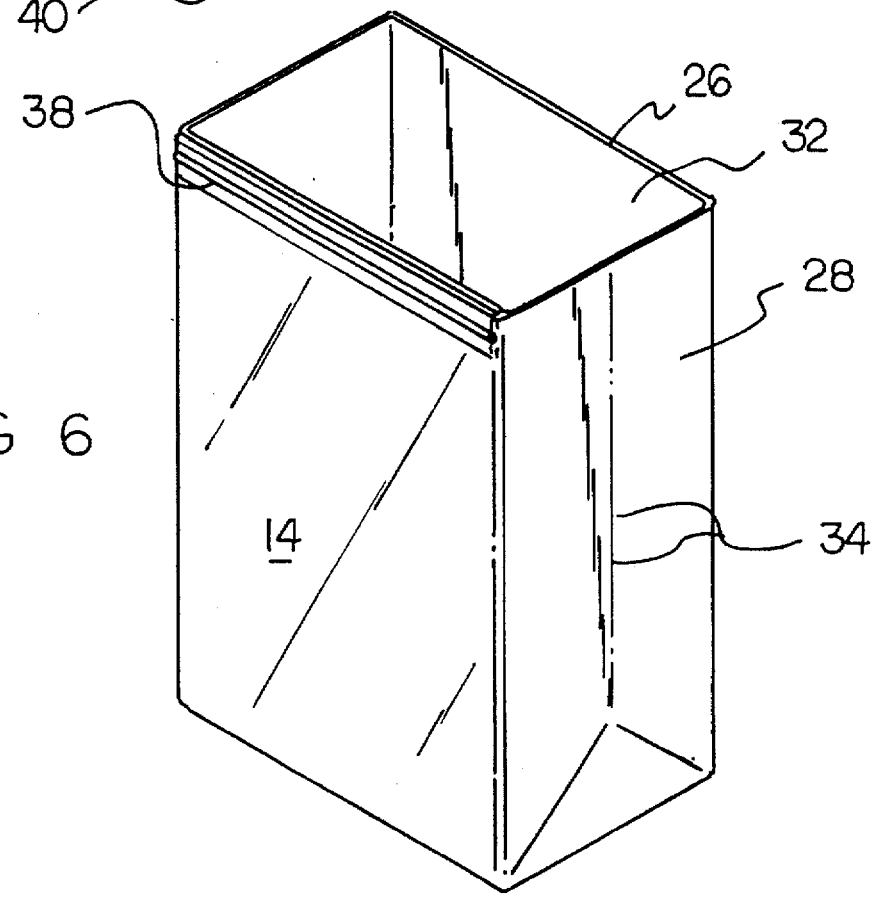
FIG. 6 is a side perspective view illustrating the zipper pouch positioned on a long side wall of the apparatus.

A flexible zipper pouch 14 is formed in an elongated rectangular configuration and is affixed to the outer surface of a first wide side wall of the bag. In the preferred embodiment the pouch is fabricated of plastic. In alternative embodiments the pouch is fabricated of paper or various other materials. The pouch is particularly useful for storing items such as hand wipes, eating utensils, and condiments such as salt, pepper and catsup. The pouch has an upper extent positioned adjacent to the upper edge of the wide side wall of the bag. The upper extent of the zipper pouch includes a snap seal coupling device 38 to permit secure storage of items within the pouch. The snap seal vacuum seals items within the pouch. Note FIG. 6.

Figure 3:
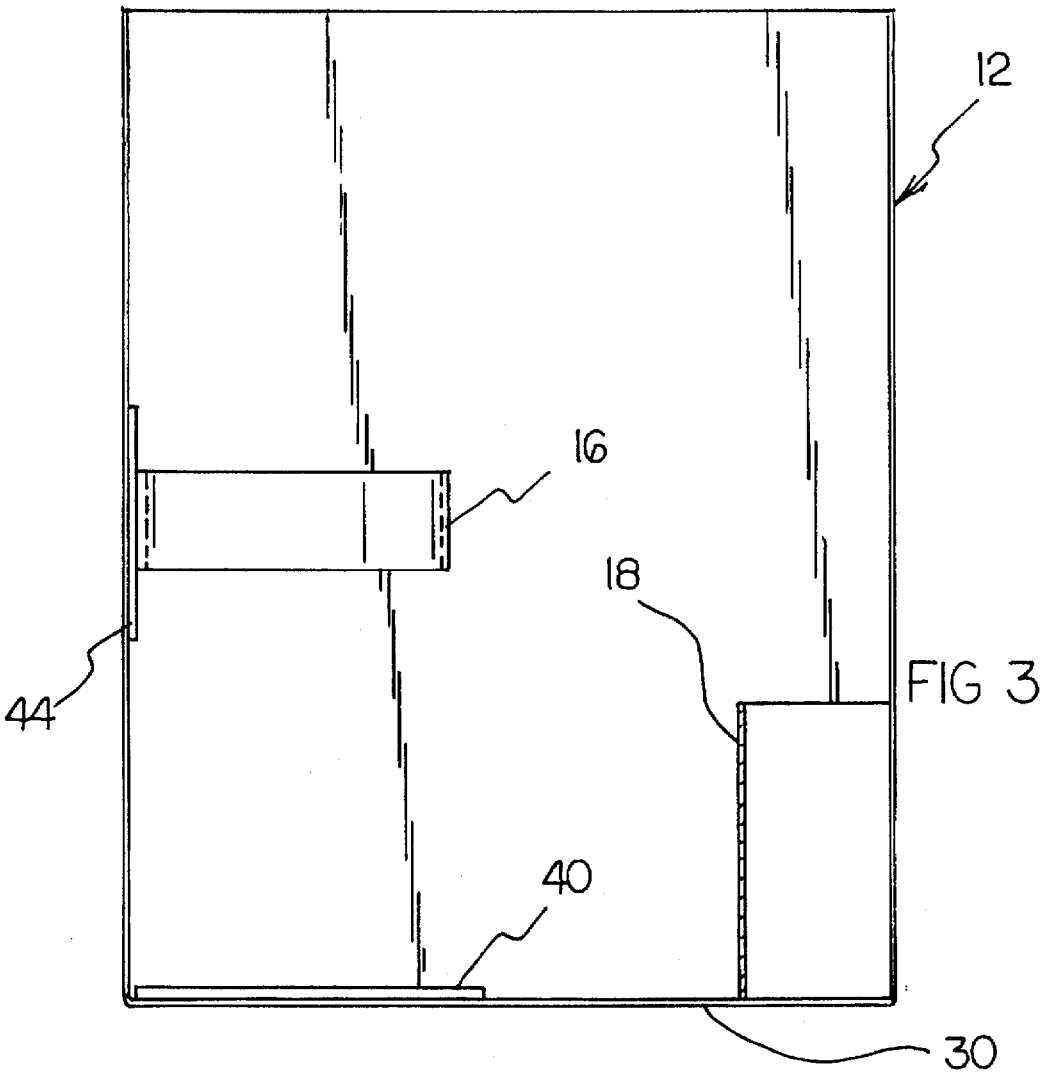
FIG. 3 is a cross sectional view of the apparatus illustrating the positioning of the drink holder ring and rectangular holder within the bag.

The floor 30 of the bag has an upper surface which includes a wax coated cardboard reinforcement member 40 positioned adjacent to a first thin side wall 42. The reinforcement member is sturdy enough to support the weight of the beverage cup when filled to capacity. The reinforcement member is particularly useful when resting the bag on a rough or curved surface. The cardboard reinforcement member will lay in a flat orientation thereby providing a secure resting surface for the beverage container. Note FIG. 3.

Figure 2:
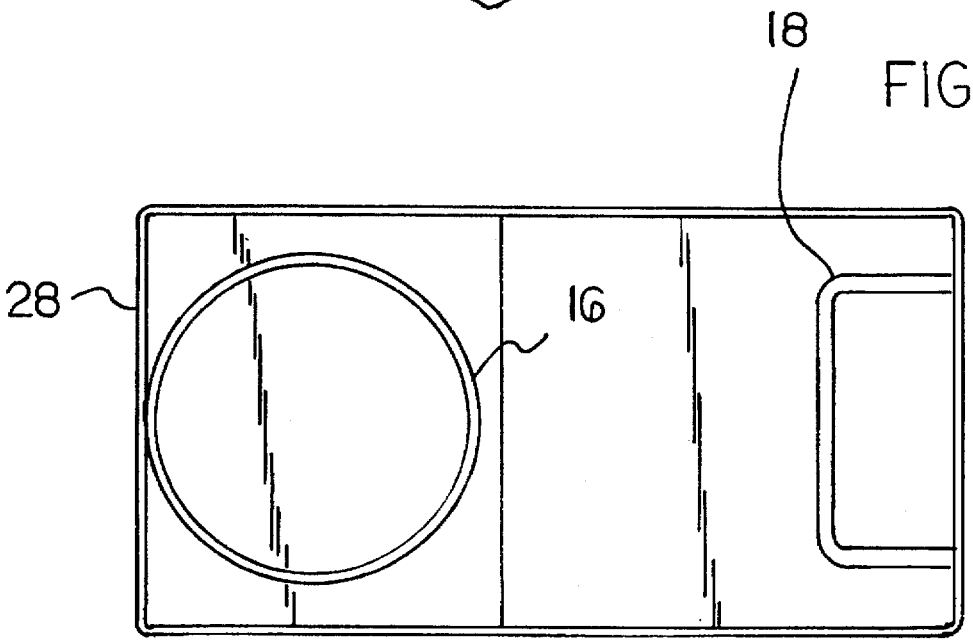
FIG. 2 is top perspective view of the apparatus illustrating the drink holder ring and rectangular holder components of the apparatus.
Figure 4:
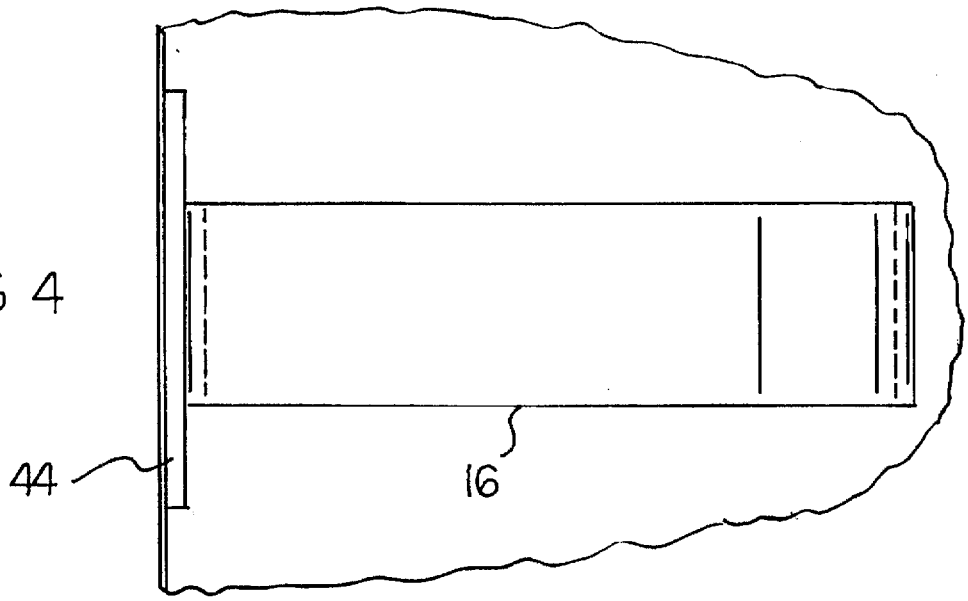
FIG. 4 is an isolated side perspective view of the drink holder ring and waxed reinforcement member which couples the ring to the inner surface of the bag.

The approximate centerpoint of the first thin side wall includes a vertically positioned waxed cardboard reinforcement member 44 affixed to it. A drink holder ring 16 is fabricated of wax coated cardboard and is formed in a generally circular configuration. The ring is affixed to the vertical reinforcement member 44. The vertical reinforcement member provides additional strength to the bag so that it may effectively support the ring particularly when a beverage cup is positioned through the ring. The ring and reinforcement member work together to retain a beverage cup in a vertical orientation within the bag. In an operative orientation the beverage cup 20 is positioned through the ring with the lower surface of the cup being positioned upon the reinforcement member on the bottom of the bag. The waxed cardboard ring and reinforcement member enable the bag to support the weight of a full beverage cup while minimizing risk of spillage. Note FIGS. 2 and 4.

Figure 5:
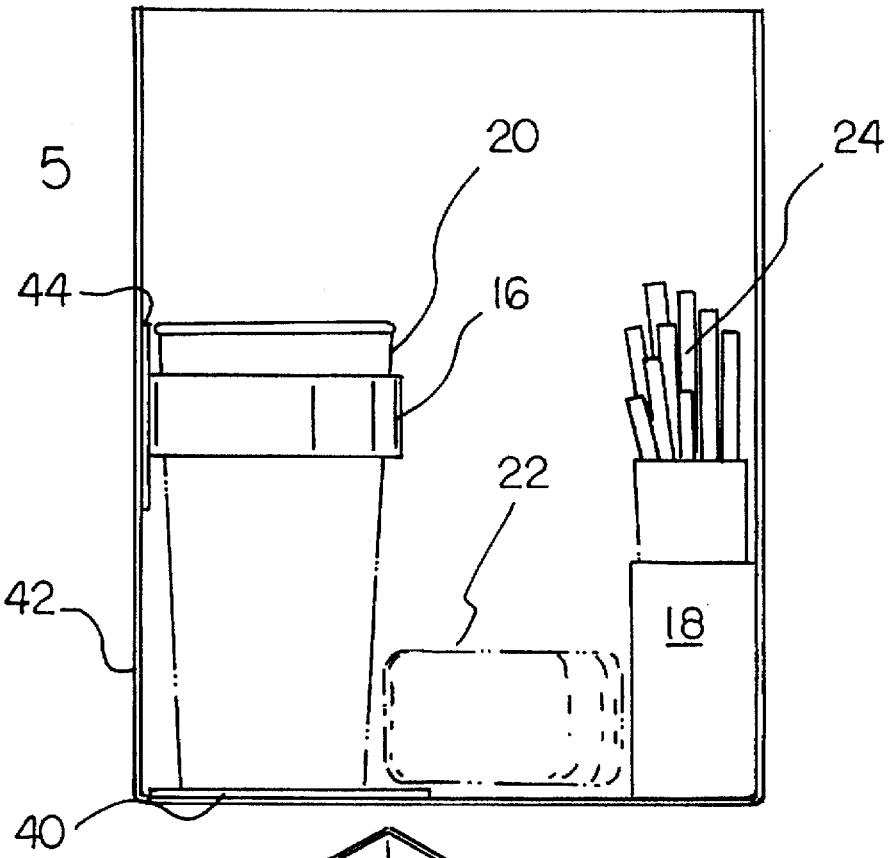
FIG. 5 is a side perspective view illustrating the positioning of a beverage container, hamburger and french fries within the apparatus.

A second thin side wall of the bag includes a generally rectangular shaped holder 18 coupled to it adjacent to the floor. The rectangular shaped holder has an open top. The rectangular configuration is ideal for storage of various food items such as french fries, hamburgers or the like. Other food items may be stored between the beverage cup and rectangular holder in the central region of the bag. The wax coating of the bag prevents the seeping of fluids through the bag. Although the inwardly positioned ring serves to prevent spillage of beverage cups, a cup filled with cold beverage will sometimes sweat due to condensation. The wax coating of the bag prevents the seepage of condensation, grease and other fluids. Note FIG. 5.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A compartmentalized food and beverage bag with reinforcement shields comprising, in combination:

a bag fabricated of wax coated paper and including two wide side walls, two narrow side walls, a floor and an open top, the walls and floor each having an inner surface and an outer surface, each side wall including an upper edge and being positioned vertically, each narrow side wall having a crease at its approximate centerpoint to permit collapsible folding of the bag;

a flexible zipper pouch formed in an elongated rectangular configuration and affixed to the outer surface of a first wide side wall of the bag, the pouch being fabricated of plastic, the pouch having an upper extent positioned adjacent to the upper edge of the wide side wall of the bag, the upper extent of the zipper pouch including a snap seal coupling device to permit secure storage of items within the pouch; and the floor of the bag having on the inner surface a wax coated cardboard reinforcement member positioned adjacent to one of the narrow side walls, the approximate centerpoint of the narrow side wall including a vertically positioned waxed cardboard reinforcement member affixed thereto, a holder ring fabricated of wax coated cardboard and formed in a generally circular configuration being affixed to the vertical reinforcement member for positioning a beverage cup, the beverage cup being positionable through the ring with a lower surface of the cup being positioned upon reinforcement member on the bottom of the bag, the waxed cardboard ring and reinforcement member enabling the bag to support the weight of a full beverage cup without risk of spillage occurring, the opposite narrow side wall of the bag including a generally rectangular shaped holder coupled thereto adjacent to the floor, the rectangular shaped holder having an open top for receiving food items, the wax coating of the bag preventing the seeping of fluids through the bag.

* * * * *